United States Patent [19]

Hacquet

[11] Patent Number: 5,048,193

[45] Date of Patent: Sep. 17, 1991

[54] ARCHERY BOW SIGHT

[76] Inventor: Rodney D. Hacquet, P.O. Box 141, Newport, Ind. 47966

[21] Appl. No.: 372,431

[22] Filed: Jun. 23, 1989

[51] Int. Cl.[5] ..... F41G 1/46

[52] U.S. Cl. ..... 33/265

[58] Field of Search ..... 33/265, 233, 237, 240, 33/252, 261; 124/87

[56] References Cited

U.S. PATENT DOCUMENTS

| | | | |
|---|---|---|---|
| 1,607,881 | 11/1926 | Dunlea . | |
| 2,925,656 | 2/1960 | Genovese | 33/265 |
| 3,013,336 | 12/1961 | Pennington | 33/265 |
| 3,212,190 | 10/1965 | Larson | 33/265 |
| 4,120,096 | 10/1978 | Keller | 33/265 |
| 4,142,297 | 3/1977 | Altier | 33/265 |
| 4,317,288 | 3/1982 | Yasui | 33/265 |
| 4,418,479 | 12/1983 | Stachnik | 33/265 |
| 4,494,313 | 1/1985 | Scott | 33/265 |
| 4,542,591 | 9/1985 | Montgomery | 33/265 |
| 4,580,349 | 4/1986 | Webb et al. | 33/265 |
| 4,616,422 | 10/1986 | Gaddy | 33/265 |
| 4,620,372 | 11/1986 | Goodrich | 33/265 |
| 4,685,217 | 8/1987 | Shader | 33/267 |
| 4,796,364 | 1/1989 | Amacker | 33/265 |

FOREIGN PATENT DOCUMENTS

| | | | |
|---|---|---|---|
| 17667 | 12/1915 | United Kingdom | 33/261 |

*Primary Examiner*—Harry N. Haroian

*Attorney, Agent, or Firm*—Fitch, Even, Tabin & Flannery

[57] ABSTRACT

An archery bow sight apparatus having a sight bar with at least one front sight that is adjustable to a fixed position relative to the sight bar, and a rear sight that is independently pivotal to maintain a vertical alignment with the ground, which combination of fixed and pivotal sights provide an archer with an improved sight means for greater accuracy in clustering his arrows in a target.

9 Claims, 2 Drawing Sheets

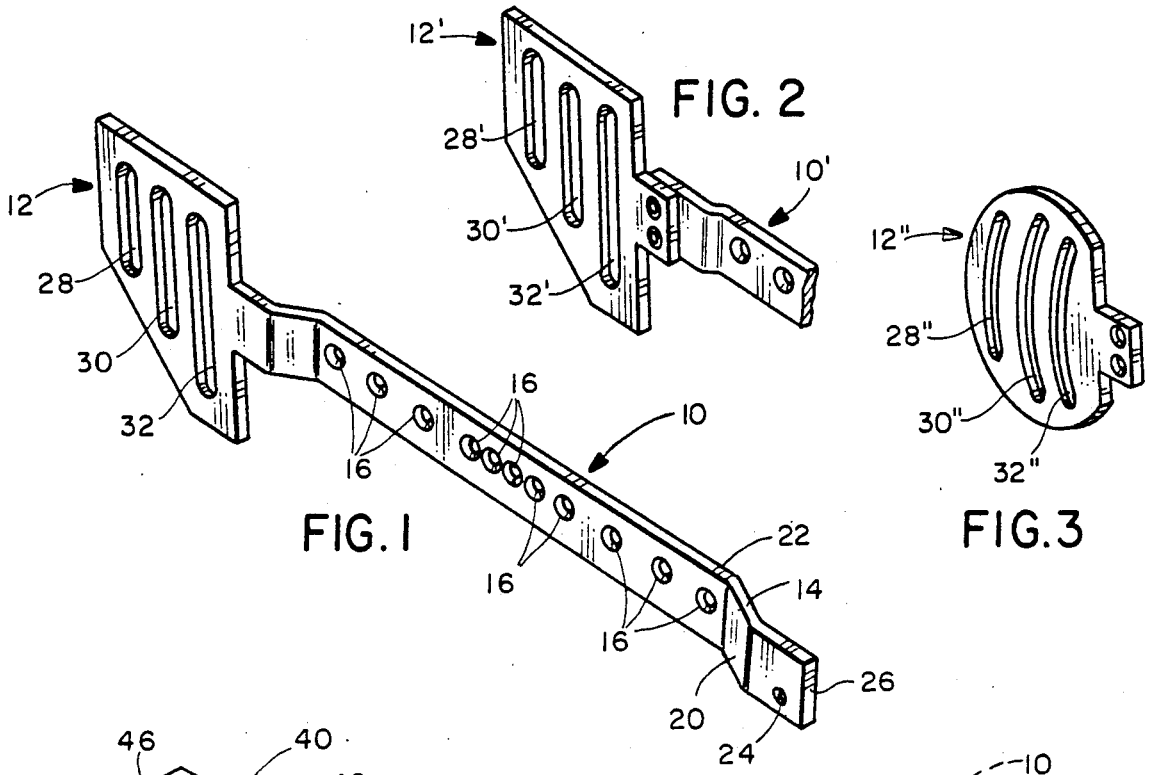
FIG. 2
FIG. 1
FIG. 3
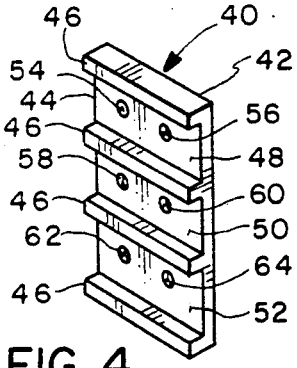
FIG. 4
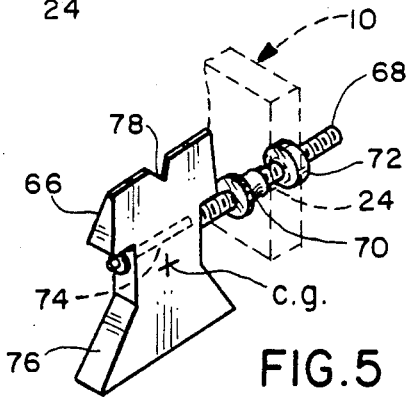
FIG. 5
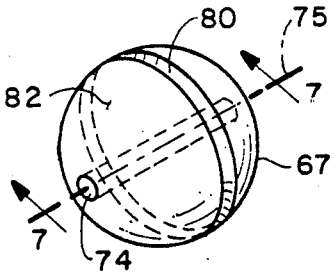
FIG. 6
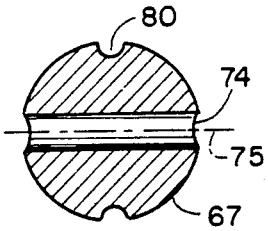
FIG. 7
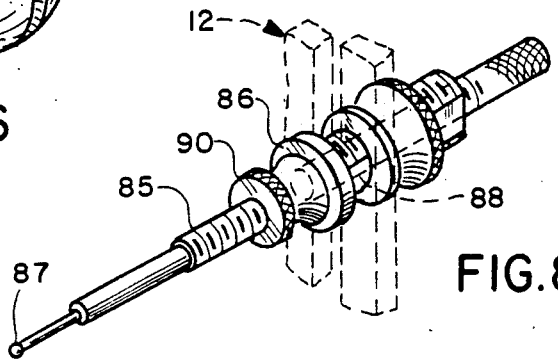
FIG. 8

ARCHERY BOW SIGHT

BACKGROUND OF THE INVENTION

The present invention relates to a sighting device for an archery bow. More particularly, the invention is directed to a bow sight with a dual sighting arrangement that has both a front and rear sight. The front and rear sights are mounted and affixed to a frame coupled to a bow or bow riser, and are operable to improve bow shooting whether in an elevated stand or on the ground.

Bow sights are utilized to improve the trajectory of arrows fired at a target by an archer. More specifically, it is desired, as in target shooting, to provide as tight a cluster or pattern of arrows in a target as possible. This compact cluster of arrows is indicative of an accurately sighted bow, as well as an able archer. Various devices and bow sights are utilized to improve the accuracy of the archer, including the following: front sights; rear sights; string-mounted devices, bow rider-mounted devices; notched sights; elevation pins, bow riser angular or rotational indicators; and, combinations of the above, as examples. These devices have a singular purpose, to improve the accuracy of the archer. Many of these devices are sold for elevated stand shooting in which the archer is in a tree and is hunting deer on the ground below the tree. One such bow sight has a front pendulum sight in front of the bow, which pivots as the bow is tilted.

Range finders for a bow frequently use at least one adjustably mounted elevation pin in a bracket to provide the archer with reference means for targeting position or distance. U.S. Pat. No. 4,580,349-Webb et al., illustrates a range finder utilized in cooperation with a string-mounted sight for sighting the bow on a target. Target alignment is accomplished through the string-mounted sight aligned with a projecting pendulum member, and one of several preset range pins, which range pin is selected is based upon the position of the pendulum member relative to vernier marks indicative of the range of the sighted target.

Screw thread adjustments may provide bow sight adjustment about the vertical and lateral axes of the bow, as shown in U.S. Pat. No. 4,142,297-Altier, as well as for basic technique adjustments about the vertical, lateral and longitudinal axes. This sighting arrangement utilizes the same structure for both rough and fine adjustments. However, these adjustments are fixed position adjustments, which require manual adjustment of the total apparatus to accommodate varying conditions. The apparatus includes a windage and/or elevation adjustment.

A dual sight apparatus, that is front and rear sight, is disclosed in U.S. Pat. No. 4,685,217 to Shader. The sight utilizes a vertical sight, which appears as a taut string or wire in the vertical direction, as well as the wind or elevation pins located at the front of the bow. This arrangement provides an added fixed reference point for the archer.

A bow sight pivotable about a fixed point attached to the bow is illustrated in U.S. Pat. No. 3,013,336 to Pennington. This device includes a wind adjustment means extending perpendicular to the pivoting sight, which is horizontally maintained by a counterweight. A scale provides an indication of the degree of inclination from the horizontal. However, the windage device is fixed to the general line-of-sight arm and therefore moves with this arm as it pivots during use of the archery bow.

Other bow sights provide pivotable members to pivot the sight for adjustment to changes in the vertical orientation of the bow, or to adjust for changes of elevation of the line of sight. U.S. Pat. No. 4,616,422 and U.S. Pat. No. 4,120,096 illustrate various alternative bow sight apparatus for aiming and firing a bow from an elevated position.

It is desirable to utilize a fixed bow sight to provide a continuous frame of reference and a variable sight to adjust to changes in the angle of inclination of the bow. Further, it is desirable to be apprised of bow rotation out of a plane normal to the ground as the rotation will displace front and rear sight alignment, thereby effectively altering the sight adjustment and varying the accuracy of the archer utilizing the sighting device.

The present invention provides a front sight with multiple fixed reference points, which can be preset for given distances, and a rear sight that is pivotal about a horizontal axis to maintain the rear sight in a generally horizontal position even though the bow is tilted from a true vertical position at the time of shooting. The pivotal rear sight is also indicative of bow rotation out of a plane vertical to the ground, as its pivoting is inhibited by such rotation.

SUMMARY OF THE INVENTION

The present invention provides a bow sight encompassing both a pivoting rear sight arrangement that compensates for variations in the elevation for line-of-sight firing and adjustable wind or elevation pins. Preferably, the pins and rear sight are affixed to a common support arm.

The pivotable rear sight is mounted on a pendulum, which pivots to remain vertical as the bow is tilted from a true vertical to assure the rear sight remains constant with eye elevation or the horizon. The front sight may be selected from a plurality of elevation pins which have been previously adjusted and set for a fixed distance, and is alignable with the rear sight for focusing on a target. The pivotable rear sight is particularly adaptable to changes in the angle of the bow riser elevation relative to the ground. That is, if the archer is shooting from an elevated position, the rear sight will pivot to retain its orientation to the horizon and then the archer may focus on a target with any of the fixed elevation or windage pins.

The bow sight assembly has a mounting bracket for the support or sight bar with three adjustment grooves or slots to accommodate the sight bar at a comfortable position for the archer. The front sight elevation pins include a bead or ball projecting from their end as a focal point, and are fitted in the slotted wind pin bracket at the forward end of the sight bar. The rear sight is positioned at the rear end of the sight bar, and projects therefrom on a mounting rod or axle generally parallel to the ground for pivotable rotation thereon. This rear sight is pivotable on the axle in response to gravitational forces as the center of mass of the rear sight is below the axis of the mounting axle.

BRIEF DESCRIPTION OF THE DRAWINGS

In the Figures of the drawing, like reference numerals identify like components, and in the drawing:

FIG. 1 is an oblique view of a single-piece sight bar and wind pin bracket;

FIG. 2 is an oblique view of a sight bar and wind pin bracket as assembled separate elements;

FIG. 3 is an oblique view of an alternative embodiment of a slotted wind pin bracket;

FIG. 4 is an oblique view of a slotted mounting bracket;

FIG. 5 is an enlarged, oblique view of a pivotable rear sight;

FIG. 6 is an enlarged, oblique view of an alternative embodiment of a pivotable rear sight;

FIG. 7 is a sectional view of the rear sight in FIG. 6 taken along the lines 7—7;

FIG. 8 is an enlarged, oblique view of a windage pin and pin collar;

DETAILED DESCRIPTION OF THE INVENTION

Figure 9:
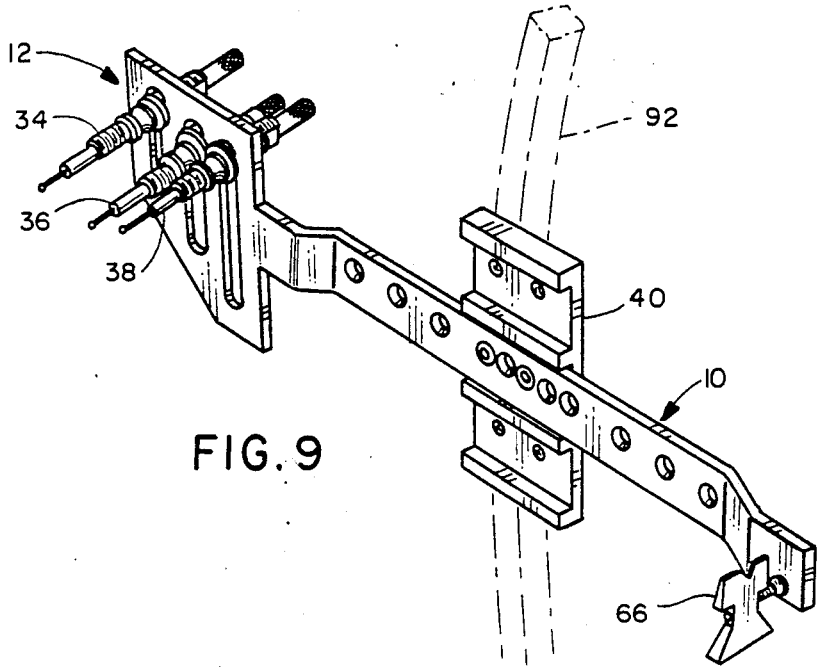
FIG. 9 is an oblique view of the dual sight assembly mounted on a bow riser.

The present invention provides a bow sight assembly for an archery bow. Present bow sights include means to accommodate shooting from an elevated perch or a ground location. These bow sights are utilized to improve the accuracy of the archer and to provide a tighter arrow cluster at the target when utilized for target shooting. Heretofore, conventional bow-sight apparatus included eyepieces or peep-sights located on the bow string; fixed-mounted line-of sight apparatus attached to the bow arc; rotatable sight apparatus to provide a steady bow sight in the case of bow variance from a vertical position, that is, vertical to the ground; and, various wind pin or elevation pin arrangements projecting from the sight apparatus.

To improve the accuracy of an arrow fired from an archery bow, a bow sight should be usable to shoot arrows from a horizontal position or from an elevated position as in a tree, and at varying distances. The bow sight arrangement, including dual-sight structures, should be operable in low-light conditions and provide a clear view through the sight apparatus to the target. In addition, the sighting apparatus will indicate to the archer any twisting of the bow hand, which would misalign the bow and consequently the target.

The present invention provides a bow sight to improve the accuracy of an archer whether on the ground or in an elevated stand and at varying distances from a target. It is adaptable to firing an arrow at or from an elevated perch, as well as being usable in low-light conditions and as an indicator of any twist in the bow alignment. The present bow sight is mountable on an archery bow and adaptable to be initially sighted or zeroed at varying distances, and to accommodate variations in shooting elevation; that is, the archer may be in a elevated perch or firing at an elevated target. The sight apparatus has a self-adjusting or aligning rear sight cooperating with front-sight, fixed elevation or windage pins, which front and rear sights are preferably affixed to a common arm. As will be explained, the preferred rear sight includes a pendulum that swings to remain at a true vertical position as the bow is tilted through various angles, and the preferred sight is a horizontal notch on top of the pendulum, which remains in a horizontal plane as the bow is tilted through various angles. Therefore, the relative relationship between the self-adjusting rear sight and the previously-set or fixed front sights, that is the windage pins, is essentially constant. The windage pins and rear sight are readily utilized from any position or in any light condition without further adjustment of the sighting device. The apparatus includes a mounting brace or yoke securable on a bow and operable to retain the sight bar with the front and rear sights. The sight bar is movable to any of the brace slots as a vertical adjustment and is longitudinally adjustable in the slot to thus provide the most comfortable and accurate position for the archer. During the initial adjustment or focusing of the sight bar and front and rear sights, the archer may fix the windage pins for fixed distances, which are vertically adjustable in slots to fixed positions to fix a target range or distance. Thereafter, the relative relationship between the rear sight and front sight will be maintained as the rear sight pivots on its axis to maintain its alignment for sighting by the archer and for alignment with any one of the elevation or windage pins. The structure and operation of the sighting mechanism will be further discussed below.

Sight bar 10 and wind pin bracket 12 are noted in FIG. 1 as a single member. Bar 10 has wall 14, as well as a plurality of locating or mounting through-passages 16 with tapered or chamfered ends 18 at inner side 20 and outer side 22 of bar 10. Through-bore 24 for rear sight mounting is provided at the back or rear end 26 of sight bar 10. Wind pin bracket 12 is mounted and secured at front end 27 of sight bar 10, and includes parallel slots 28, 30 and 32 for adjustable sight pins 34, 36 and 38, respectively, as noted in FIG. 9. It is appreciated that wind pin bracket 12 may be a separate element and joined to sight bar 10 at bar end 11 by securing means 13, such as socket screws, as shown in FIG. 2. In an alternative embodiment, wind bracket 12 is illustrated in FIG. 3 with curved outer surfaces and arced slots **28*a*, 30*a* and 32*a* for receiving pins 34, 36 and 38, respectively. The forms of the wind pin bracket 12** are merely exemplary and not a limitation.

A mounting brace or yoke 40 may be mounted on the arc of the bow 92, as illustrated in FIG. 9 by means known in the art. In FIG. 4, mounting brace or yoke 40 has an outer face 42 and an inner face 44. Parallel ribs 46 extend from inner face 44 to provide slots 48, 50 and 52 therebetween. As illustrated in FIG. 4, a plurality of through-bores 54, 56, 58, 60, 62 and 64 extend, respectively, through slots 48, 50 and 52 in pairs, which bores are alignable with sight bar passages 16 to receive securing means, such as screws or rivets, to retain sight bar 10 in brace 40.

A preferred embodiment of the rear pivotable sight 66 is illustrated in FIGS. 5 and 9. In FIG. 5, rear sight 66 is shown, in an enlarged view, mounted on mounting axle 68 at first end 65, which axle 68 extends through passage 24 in sight bar 10, and is secured at second end 69 in sight bar 10 by front and rear mounting axle lock nuts 70 and 72. In FIG. 5, rear sight 66 has a cross bore 74, shown in dashed outline, to receive axle 68 at first end 65, which cross bore 74 is positioned in the body of rear sight 66 at a point vertically above the center of gravity, c.g., of rear sight 66. Thus, the lower portion 76 of rear sight 66 will pivot on axle 68 in response to gravity to maintain a lower orientation on axle 68 than the sight slot 78 of rear sight 66.

In an alternative embodiment, rear sight 67 is illustrated in FIGS. 6 and 7 in a generally spherical shape, and has a cross bore 77 with a diametrical axis 75 extending therethrough. A circumferential groove 80 is provided in outer surface 82 of sphere 67 and is generally perpendicular to diameter 75. When rear sight 67 is mounted on axle 68, the bottom of groove 80 will maintain its orientation relative to pins 34, 36 and 38. The rear sights 66 or 67 are generally mounted in proximity to the bow string (not shown) and the wind pins are generally forward of the bow riser 92.

An exemplary sight or windage pin 85 is illustrated in FIG. 8, which sight pin 85 is mountable in pin collar 86 through through-bore 88. Pin collar 86 and sight pin 85 are thereafter mounted and secured in wind pin bracket 12 at a fixed position by first and second pin collar lock nuts 90 and 91 at the bracket front face and rear face, respectively. The wind pins 34, 36 and 38 can thus be seen to be adjustable in slots 28, 30 and 32, respectively by merely loosening their respective collars and lock nuts. Sight pin 85 includes a sight bead 87 for alignment with slot 78 of rear sight 66 for more accurately sighting a target and aiming an arrow.

The mounting brace or yoke 40 is secured to an archery bow or riser 92, as illustrated in FIG. 9, by means known in the art, such as screws, bolts, rivets or other means. Thereafter, mounting or sight bar 10 is mounted and secured in brace 40 in one of slots 48, 50 or 52 by securing means, such as, bolts or rivets, extending through passages 16 and one of the pairs of passages 54 to 64 in the slots 48, 50 or 52. Thus, the sight bar is adjustable and secured in a slot at a position comfortable to the user for sighting along the sight bar through rear sight 24 and wind pins 34, 36, or 38, as shown in FIGS. 10–12.

Windage pins 85 are generally utilized to set the range or distance of the bow and these pins are accordingly sighted and adjusted prior to use. Illustrative of this arrangement is the sighting configuration noted in FIG. 12. The horizontal plane is generally along the line of sight and a measured distance is provided between the archer and the measured distance-targets noted by the letter X at the terminus of arcs a, b and c. As noted in FIG. 12, the arrows are not propelled on a straight line, but, generally follow a parabolic arc through the air. Thus, the archer predetermines the distance ranges for accuracy to a target, and adjusts the wind pins for sighting with the rear sight based upon the horizontal distance between the archer and the target point. Therefore, the wind pins 34, 36 and 38 are each adjusted to accommodate various target distances, as shown in FIG. 12. The wind pins are secured in wind pin bracket 12 by pin collars and lock nuts 86 and 90.

Figure 10:
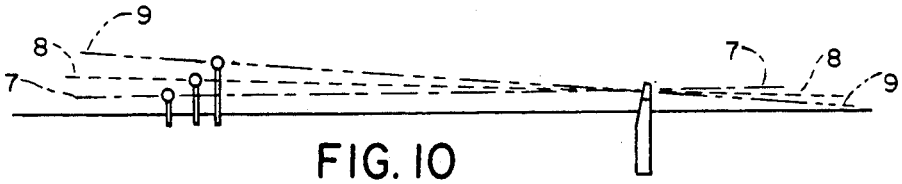
FIG. 10 is a line-of-sight projection from an archer through the elevation pins and rear sight in the horizontal plane.
Figure 11:
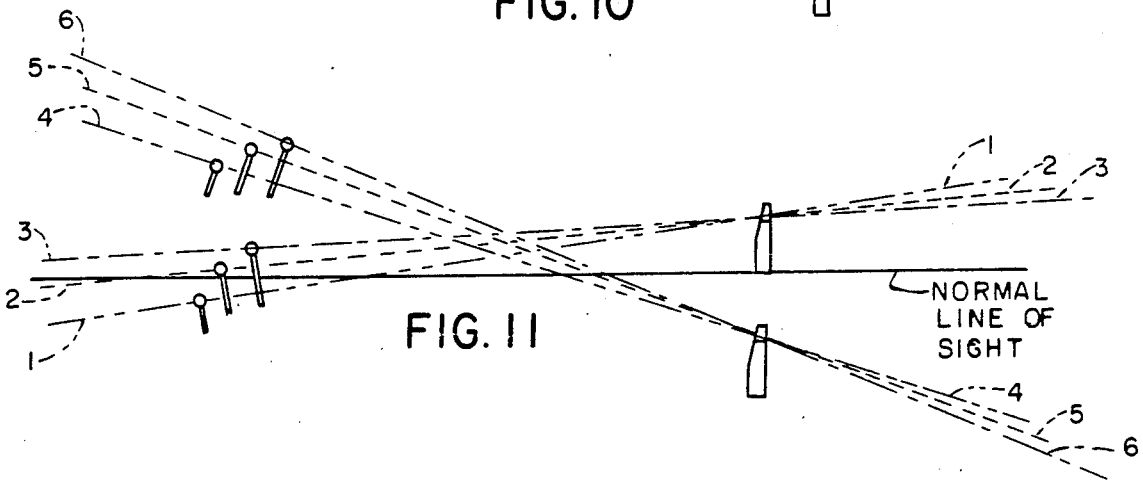
FIG. 11 illustrates line-of-sight projections from a position lower than and higher than a horizontal line of sight as in FIG. 13.
Figure 12:
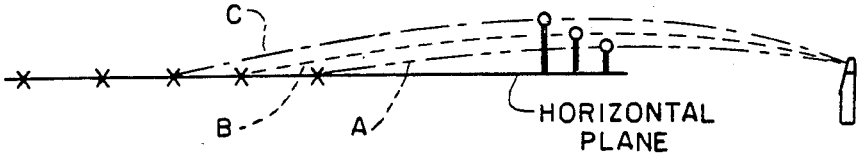
FIG. 12 illustrates the line of travel of an arrow at various sight lines and various distances.

As illustrated in FIGS. 10 and 11, the archer may sight through slot 78 in rear sight 66 along any of the sight pins 34, 36 or 38 at their respective beads 87. As the angle of the bow changes relative to the horizontal plane noted in FIGS. 10 and 11, the position of rear sight 78 remains relatively constant. That is, the rear sight means includes a pendulum means that pivots on a horizontal axis to maintain a true vertical position irrespective of the degree of tilt of the bow to a true vertical position. The sight notch is horizontally disposed on the top of the pendulum, and remains horizontal as the bow is tilted. Thus, the rear sight 66, because it is a pendulum rotatable on a horizontal axis, is perpendicular to the horizontal line of sight. The center of gravity of this rear sight 66 is below its cross bore 74, through which axle 68 extends, thus allowing the rear sight 66 to pivot and maintain its perpendicular orientation relative to the horizontal plane. Therefore, as the angle of the bow changes in a plane perpendicular to the ground, the rear sight, which is preferably a notch cut in the top edge of the pendulum, remains horizontal as the bow is tilted relative to the pendulum, with the result that the archer maintains a consistent line of sight through the sighting assembly. As rear sight 66 is positioned away from the immediate vicinity of the archer's eye, it affords him a better opportunity to sight along slot 78, which separation was not previously available with the sights mounted on bow strings. Further, rotation of rear sight 66 or the lack of rotation about the axle 68 affords the archer an indication that the bow may not be perpendicular to the plane of the ground or is otherwise inclined or twisted relative to the archer's hand, which can negatively affect the alignment of the bow and consequently the accuracy of the arrow. The particular shape of the pendulum or pivotal rear sight means may be changed from that illustrated and other sights beside a notch may be mounted on the pendulum and still fall within the purview of the invention.

In the alternative embodiment in FIGS. 6 and 7, rear sight 67 is operable to consistently provide a rear sight notch along the edge of groove 80. Sight 67 can thus be aligned with any of windage pins 34, 36, or 38 as the angle of elevation changes or varies.

While only specific embodiments of the invention have been described and shown, it is apparent that various alterations and modifications can be made therein. It is, therefore, the intention in the appended claims to cover all such alterations and alterations as may fall within the scope and spirit of the invention.

What is claimed is:

1. A bow sight for an archery bow, which bow is operable to propel arrows, said bow sight comprising:

a sight bar with a front end and a back end;

means for securing said sight bar to said bow intermediate the ends of the sight bar;

a front sight having a wind pin mounting bracket with at least one slot, which front sight is mounted on said sight bar front end forwardly of said bow;

a plurality of wind pins, at least one wind pin positioned in each of said slots, which pins are adjustable to match the trajectory of arrows at fixed distances;

a rear sight mounted on said sight bar back end rearwardly of said bow;

said rear sight having an upper edge, a lower edge and a center of gravity;

a sighting notch positioned at said rear sight upper edge, a pivot shaft bore between said upper edge and said center of gravity;

said sight bar having a longitudinal axis, a front surface, and a mounting port at said back end, which mounting port is perpendicular to said inner surface and said longitudinal axis;

a rear sight pivot shaft extending through said mounting port and having said rear sight pivotally mounted on said pivot shaft in said shaft bore;

means for locking said pivot shaft and rear sight in said mounting port;

said rear sight pivotable to maintain, as the bow is inclined relative to a horizontal plane, alignment with at least one of said front sight wind pins for a more consistent arrow trajectory at a predetermined distance.

2. A bow sight as claimed in claim 1 wherein said mounting bracket has a front face and a rear face; a locking means comprising a pin collar, a first pin collar lock nut, and a second pin collar lock nut; said pin collar defining a longitudinal through-passage to receive said sight pin, which sight pin is secured in said pin collar by one of said first and second pin collar lock nuts at said front face;

said pin collar positioned in said slot and secured therein at a fixed position by the other of said first and second said pin collar lock nuts contacting said rear face.

3. A bow sight as claimed in claim 1 wherein said rear sight notch and upper edge are aligned with the earth horizon when said bow is perpendicular to said horizon.

4. A bow sight as claimed in claim 1 wherein said means for securing said sight bar to said bow is a mounting brace having a front face, a rear face, and at least one groove on said front face to receive said sight bar and further comprising;

second securing means;

said brace defining at least two passages in each of said grooves;

said sight bar having a plurality of cross bores, which cross bores are alignable with said brace passages to receive said second securing means to mount said sight bar on said brace and bow.

5. A bow sight as claimed in claim 4 wherein said bow has a mounting surface;

said mounting brace has a plurality of said grooves;

said brace front face is approximately parallel to said bow mounting surface; said sight bar is mounted and positioned in one of said grooves; and said sight bar inner surface is approximately parallel to said brace front face and bow mounting surface.

6. A bow sight as claimed in claim 5 wherein sight bar is horizontally adjustable in said groove by alignment of any of said sight bar cross bores with said mounting brace groove passages.

7. A bow sight as claimed in claim 6 wherein said sight bar is positionable in any of said mounting brace plurality of grooves to provide a vertical adjustment means for said bow sight.

8. A bow sight for an archery bow as claimed in claim 4 wherein said bow has a bow riser;

said bow sight brace mounted on said bow riser and generally perpendicular thereto;

said front sight mounted on said bracket in front of said bow riser; and, said rear sight mounted on said sight bar rearward of said bow riser, which front sight and rear sight are alignable with a target to improve the accuracy of the arrow to a target.

9. A bow sight as claimed in claim 8, wherein said archery bow has an upper end and a lower end with a bow string connected therebetween, said bow string operable between a reference position and an extended position;

said rear sight is a pendulum sight in proximity to said bow string at said reference position and pivotable to maintain its horizontal alignment with changes in the vertical orientation of said bow and bow string.

* * * * *